US005307742A

United States Patent [19]

Jones

[11] Patent Number: 5,307,742

[45] Date of Patent: May 3, 1994

[54] EMI/RFI/ESD SHIELD FOR ELECTRO-MECHANICAL PRIMER FUSES

[75] Inventor: Peter M. Jones, Londonderry, N.H.

[73] Assignee: Chomerics, Inc., Woburn, Mass.

[21] Appl. No.: 946,199

[22] Filed: Sep. 17, 1992

[51] Int. Cl.[5] ..... F42B 3/182

[52] U.S. Cl. ..... 102/202.2; 102/202.3; 102/472

[58] Field of Search ..... 102/202.1, 202.2, 202.3, 102/472, 202.5

[56] References Cited

U.S. PATENT DOCUMENTS

| | | | |
|---|---|---|---|
| 3,363,565 | 1/1968 | Walther | 102/472 |
| 3,638,071 | 1/1972 | Altonen, Jr. et al. | 102/202.3 |
| 4,170,939 | 10/1979 | Hoheisel et al. | 102/202.3 |
| 4,206,707 | 6/1980 | Shores | 102/472 |
| 4,271,761 | 4/1979 | Canning et al. | 102/504 |
| 4,369,707 | 1/1983 | Budde | 102/202.2 |

FOREIGN PATENT DOCUMENTS 2654619 6/1978 Fed. Rep. of Germany ..... 102/472

OTHER PUBLICATIONS

Technical Bulletin 202, "Cho-Foil TM 101" of Chomerics, Incorporated ©1983.

*Primary Examiner*—Stephen M. Johnson

*Attorney, Agent, or Firm*—John Dana Hubbard; Kevin S. Lemack; William L. Baker

[57] ABSTRACT

A shielding device such as for a primer fuse is disclosed. The shielding device is multi-layered, and combines the shielding affectivity of metal foil with electrically conductive adhesive and a dielectric film. Upon application of the shielding device, the primer in the base of the shell is shielded, yet an electrical connection can be made upon firing the pin to fire the round without requiring removal of the shielding device.

17 Claims, 2 Drawing Sheets

EMI/RFI/ESD SHIELD FOR ELECTRO-MECHANICAL PRIMER FUSES

BACKGROUND OF THE INVENTION 105 mm shells are in common use in tanks. One drawback of the primer mechanisms associated with these and similar shells is the ability of the enemy to jam the same. That is, the conventional primer mechanism includes an electrically charged firing pin that strikes the primer fuse and generates a spark. If the electrical current on the pin is jammed, no spark will be created and the tank will not fire, or the primer mechanism will operate improperly.

One solution to this problem is the use of foil tape as a bridge wire in a cross configuration on the base of the shell casing, covering the electro mechanical primer fuse. However, the tape must be removed either before or after the shell is loaded, thereby adding unacceptable time and motion to the firing sequence. In addition, the tape may short the fuse.

Accordingly, there exists a need for an effective means of shielding the electro mechanical primer fuse from radio frequency, electro magnetic interference, and electro static discharge which does not suffer from the drawbacks of the prior art.

SUMMARY OF THE INVENTION

The problems of the prior art have been solved by the instant invention, which provides a shielding device for primer fuses. The device of the instant invention can be retrofitted or applied during the manufacturing of the primer mechanism, and will function through the storage life up to and including the activation of the fuse. More specifically, the shielding device of the instant invention is multi-layered, and combines the shielding affectivity of metal foil with electrically conductive adhesive and a dielectric film. Upon application of the shielding device, the primer in the base of the shell is shielded, yet an electrical connection can be made upon firing the pin to fire the round without requiring removal of the shielding device.

DETAILED DESCRIPTION OF THE INVENTION

Figure 2:
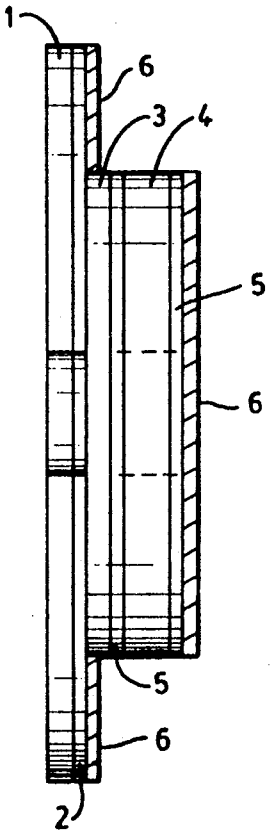
FIG. 2 is a side view of the shielding device in accordance with one embodiment of the instant invention.
Figure 1:
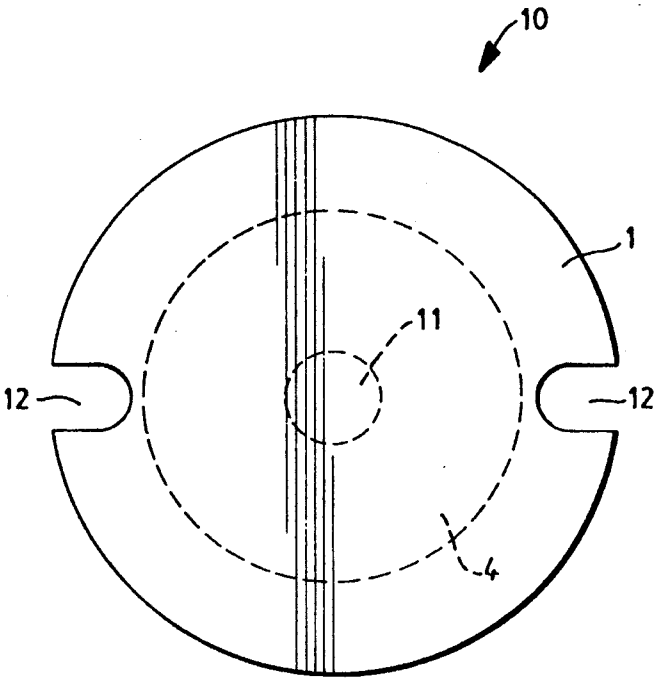
FIG. 1 is a top view of the shielding device with the release paper backing removed, in accordance with one embodiment of the instant invention.

For convenience, the following description is provided in the context of 105 MM shells, although it should be understood that the instant invention is applicable to other size shells as well. Turning now to FIGS. 1 and 2, there is shown one embodiment of the instant shielding device 10. Layer 4 is a dielectric film, preferably a polyester such as Mylar TM . Other suitable dielectric film include polyimides, nylons, and/or polyetheramides. An non-conductive adhesive (layer 5 in FIG. 2) is applied to both sides of layer 4. Layers 4 and 5 are smaller in diameter than layers 1 and 2, and are preferably centered with respect to layers 1 and 2. Layer 1 is a metal foil, and is preferably coated with a conductive adhesive (layer 2 in FIG. 2), although other means of establishing electrical conductivity between the foil layer and the substrate to which it is applied can be used. Prior to use, a protective layer 6 FIG. 2 such as a release paper backing covers layers 5 and 2. Such protective layers are well known and are commonly formed of a coated paper or plastic sheet which has the ability to adhere to the adhesive layer so as to be removable under slight pressure without injuring the adhesive layer. Preferably the protective layer 6 is silicone coated release paper, and is 0.0035 inches thick. The shield is applied simply by removing the protective layer 6 thereby exposing the adhesives.

The metal foil layer may be formed of any electrically conductive metal. It may also consist of a laminate of two or more metal foils. Preferably, the selected metal is non-corrosive, highly conductive, and has a high tensile strength in a thin sheet form. Suitable metals include gold, silver, aluminum, tin, zinc, nickel, copper, platinum, palladium, iron and its alloys, steel, stainless steel and various alloys of such metals. Additionally, the foil may be a plated, coated or clad metal foil, such as a noble metal coated non noble metal foil. The noble metal coating, plating or cladding on non noble metal foils is preferred as it is not subject to corrosion or oxidation and is highly conductive. Such foils include but are not limited to silver coated copper, aluminum, zinc, iron, iron alloys, steel including stainless steel, nickel or cobalt; gold coated copper, aluminum, tin, zinc, iron, iron alloys, steel including stainless steel, nickel or cobalt. Additionally, various non noble metal coated or plated foils may be used, such as tin coated copper, tin coated aluminum and nickel coated copper. The preferred foil is tin plated copper foil, as copper has excellent electrical properties and the tin plating enhances resistance to environmental conditions.

Preferably the conductive and non-conductive adhesives are pressure sensitive, which are tacky at room temperature and do not require elevated temperature curing. By pressure sensitive, it is meant that the adhesive establishes a tight bond with the substrate to which it is applied under normal finger or hand pressure. Suitable pressure sensitive adhesives are well known and generally formed from various rubbers, natural and synthetic, such as silicone, fluorosilicone and neoprene rubber, or synthetic polymers such as styrene butadiene copolymers and other such elastomeric copolymers, acrylics, acrylates, poly vinyl ethers, polyvinyl acetate copolymers, polyisobutylenes and mixtures thereof. An acrylic pressure sensitive adhesive is preferred.

In the case of the conductive pressure sensitive adhesive, it generally contains one or more conductive fillers in an amount sufficient to provide the desired conductivity. The fillers can be of any shape and size useful in such adhesives. Generally, the fillers are in the form of particles, flakes or fibers. The fillers may be of a size from submicron to about 400 microns across their largest diameter. Generally, fillers range in size from about 1 micron to 100 microns, more preferably about 20 to about 60 microns. The amount of filler should be sufficient to provide the desired electrical conductivity, and generally range from about 1% by total weight of filler and adhesive to about 25% by total weight of filler and adhesive. Preferably, the amount of filler is from about 5% to 15% by total weight. The one or more electrically conductive fillers include but are not limited to solid metal fillers or solid carbon or graphite fillers. The fillers may also be plated particles such as noble metal plated metals, plastics or glass including but not limited to silver coated copper powder, silver coated glass, and silver coated plastic. Silver plated copper particles are preferred. The means by which the adhesive is rendered conductive is not critical to the invention and any suitable means that provides the desired conductivity and adhesion may be used.

Since layers 4 and 5 are smaller in diameter than layers 1 and 2, the conductive adhesive layer 2 coated on layer 1 can provide an electrical path between the metal foil layer 1 and a metal housing 20 (FIG. 3) that contains the electro mechanical primer fuse. As a result, the shield is grounded.

An aperture 11 is formed in layers 4 and 5, which is illustrated as circular but can be any shape that fulfills the function thereof as discussed hereinafter. An interfacing layer 3 having an outside diameter corresponding to that of layers 4 and 5 is sandwiched between 1, 2 and 4, 5. Layer 3 is provided to form an interface between the sticky adhesives so that upon retraction of the firing pin as discussed below, the metal foil layer will lift away from the primer. Layer 3 should be formed of a material which can provide such an interface, will deflect in accordance with the operation of the shield, and is electrically conductive. Noble metals are such suitable materials. Preferably the layer 3 is formed of beryllium copper, type CA172. The aperture 11 does not extend to layer 3.

The shield 10 is assembled in fixtures after die cutting the individual parts from precoated foils and films. The dielectric film is preferably about 0.10 inches thick. The metal foil layer is preferably about 0.0014 inches thick (in the case of copper, the copper is 1 oz per square foot). The conductive adhesive layer is 0.0014 inches thick, and both non-conductive adhesive layers are 0.001 inches thick. The interfacing layer 3, in the case of beryllium copper, is preferably about 0.002 inches thick.

A plurality of notches 12 (two shown) can be formed in layers 1 and 2 to assist in aligning the center of the shield 10 over the primer.

Figure 3:
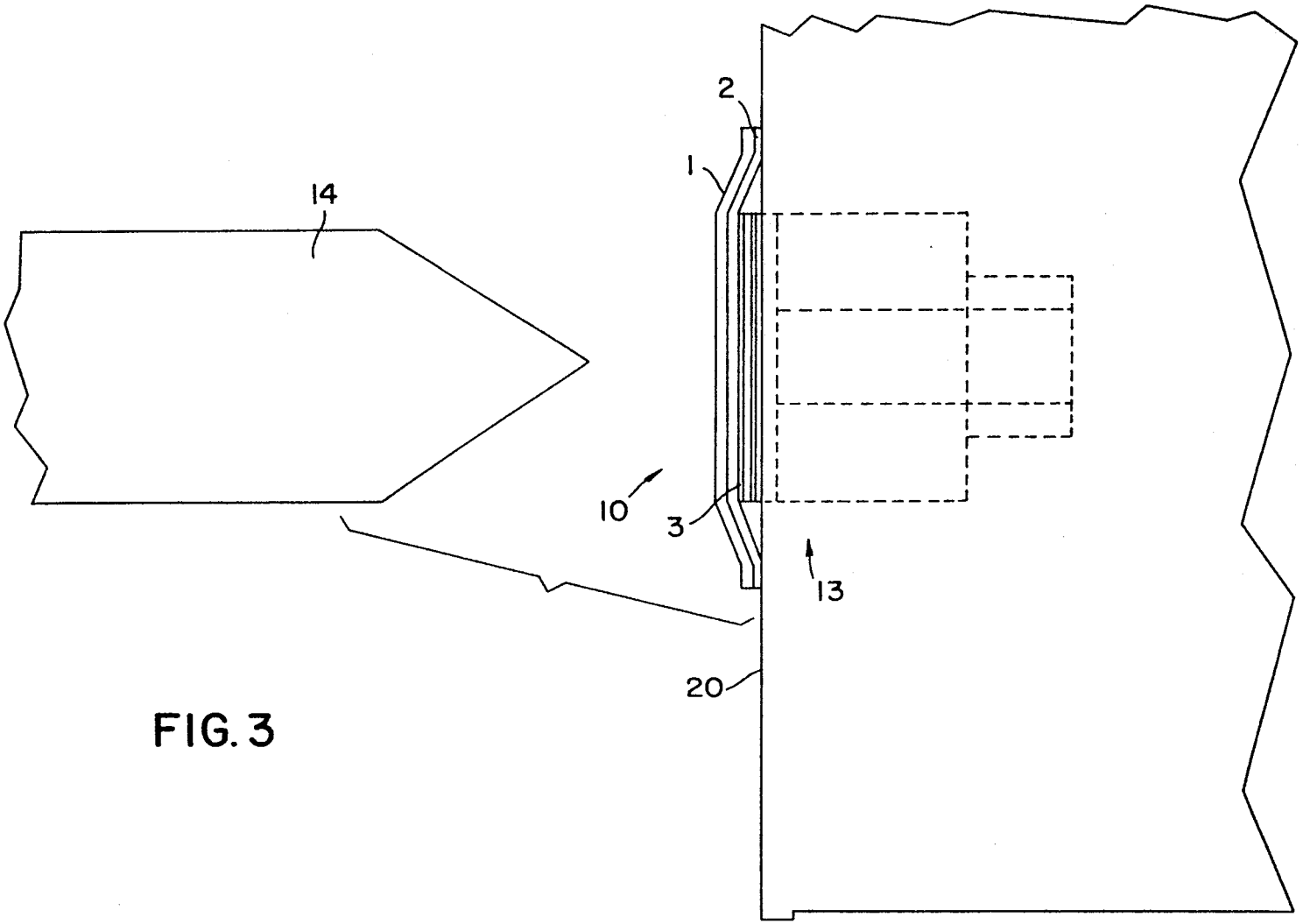
FIG. 3 is an illustration of the firing pin and primer fuse including the shielding device of the instant invention.

Turning now to FIG. 3, a primer fuse housing 20 is shown housing primer fuse 13. The primer is electromechanically controlled by a switch that delivers 20 volts for 35 milliseconds to the primer. The switch will activate a spring loaded pin in the control thereby firing the round.

The shielding device 10 is positioned over the fuse 13, with electrically conductive adhesive layer 2 securing to the surface of housing 20. With the shielding device 10 so positioned, the shell is shielded from RFI, EMI and ESD energy and can be stored for the service life of the shell.

When the shell is loaded into the breech of a gun, the firing pin 14 of the gun is advanced toward the primer. When the firing pin 14 contacts the shield 10, layers 1, 2 and 3 of the shield 10 will deflect through aperture 11 of layers 4 and 5 until contact is made with the primer 13. An electric charge applied to the firing pin will pass through the shield and activate the primer and fuse in accordance with the proper functioning thereof. The shell is then removed from the gun.

The retraction of the firing pin will cause layers 1, 2 and 3 to lift away from the primer and break the electrical path. The shell can then be stored again with the same shielding performance and storage requirements.

While the present invention has been described in reference to its preferred embodiments, other variations, modifications and equivalents would be obvious to one skilled in the art and it is intended in the specification and appended claims to include all such variations, modifications and equivalents therein.

What is claimed is:

1. A shielding device for a primer fuse, said shielding device comprising:

a metal foil layer having an outer surface and an inner surface;

a conductive adhesive layer on said inner surface of said metal foil layer;

a dielectric film layer having a first surface facing said inner surface of said metal foil layer, and a second surface facing opposite said first surface;

non-conductive adhesive layers on said first and second surfaces of said dielectric layer; and an interfacing layer between said non-conductive adhesive on said first surface of said dielectric layer and said conductive adhesive layer.

2. The shielding device of claim 1, further comprising an aperture formed through said dielectric layer and non-conductive adhesive layers.

3. The shielding device of claim 1, further comprising a protective layer covering said conductive adhesive layer, and said non-conductive adhesive layer on said second surface of said dielectric layer.

4. The shielding device of claim 1, wherein said interfacing layer is positioned on said conductive adhesive layer such that a portion of said conductive adhesive layer remains exposed.

5. The shielding device of claim 4, wherein each of said layers has a substantially circular configuration, and wherein said exposed portion of said conductive adhesive layer comprises an outer cirfumferential portion of said conductive adhesive layer.

6. The shielding device of claim 1, wherein said interfacing layer is selected from the group consisting of noble metals and beryllium copper.

7. The shielding device of claim 1, wherein said interfacing layer is beryllium copper.

8. A primer fuse shielded from radio frequency interference, electro magnetic interference and electro static discharge, comprising a housing containing said fuse, and a shielding device affixed to said housing, said shielding device comprising:

a metal foil layer having an outer surface and an inner surface;

a conductive adhesive layer on said inner surface of said metal foil layer;

a dielectric film layer having a first surface facing said inner surface of said metal foil layer, and a second surface facing opposite said first surface;

non-conductive adhesive layers on said first and second surfaces of said dielectric layer; and an interfacing layer between said non-conductive adhesive on said first surface and said conductive adhesive layer.

9. The primer fuse of claim 8, wherein said shielding device further comprises an aperture formed through said dielectric layer and non-conductive adhesive layers.

10. The primer fuse of claim 8, wherein said interfacing layer is positioned on said conductive adhesive layer such that a portion of said conductive adhesive layer remains exposed.

11. The primer fuse of claim 10, wherein each of said layers has a substantially circular configuration, and wherein said exposed portion of said conductive adhesive layer comprises an outer cirfumferential portion of said conductive adhesive layer.

12. The primer fuse of claim 8, wherein said interfacing layer is selected from the group consisting of noble metals and beryllium copper.

13. The primer fuse of claim 8, wherein said interfacing layer is beryllium copper.

14. A method of providing electrical contact between a firing pin of a gun and a primer of a shell for said gun that is shielded from radio frequency interference, electro magnetic interference and electro static discharge, comprising:

causing said firing pin to advance toward said primer;

contacting said firing pin with a shielding device comprising:

a metal foil layer having an outer surface and an inner surface; a conductive adhesive layer on said inner surface of said metal foil layer; a dielectric film layer having a first surface facing said inner surface of said metal foil layer, and a second surface facing opposite said first surface; non-conductive adhesive layers on said first and second surfaces of said dielectric layer; an interfacing layer between said non-conductive adhesive on said first surface and said conductive adhesive layer; and an aperture formed in said non-conductive adhesive layers and said dielectric layer;

said metal foil layer deflecting upon impact from said firing pin through said aperture and electrically contacting said primer to cause an electrical current to pass from said firing pin to said primer.

15. The method of claim 14 wherein said electrical contact of said metal foil layer and said primer is created through said interfacing layer.

16. The method of claim 14 wherein said interfacing layer is selected from the group consisting of noble metals and beryllium copper.

17. The method of claim 14 wherein said interfacing layer is beryllium copper.

* * * * *